US005364184A

United States Patent [19]

Rains

[11] Patent Number: 5,364,184

[45] Date of Patent: Nov. 15, 1994

[54] COUPLING METHOD FOR HIGH POWER MAGNETIC DEVICES

[75] Inventor: Robert L. Rains, Oxnard, Calif.

[73] Assignee: General Signal Corporation, Stamford, Conn.

[21] Appl. No.: 21,025

[22] Filed: Feb. 23, 1993

[51] Int. Cl.[5] ..... B01F 13/08

[52] U.S. Cl. ..... 366/273; 366/274; 366/205

[58] Field of Search ..... 366/273, 274, 205, 199, 366/207, 331, 314, 342, 343; 464/29; 403/DIG. 1

[56] References Cited

U.S. PATENT DOCUMENTS

| | | | |
|---|---|---|---|
| 2,437,871 | 3/1948 | Wood | 464/27 |
| 3,304,990 | 2/1967 | Ontko et al. | 494/84 |
| 3,542,178 | 11/1970 | Ripple | 366/205 |
| 3,572,651 | 3/1971 | Harker | 366/273 |
| 3,596,692 | 8/1971 | Swanke | 366/205 |
| 4,162,855 | 7/1979 | Bender | 366/274 |
| 4,577,975 | 3/1986 | McCrory et al. | 366/205 |
| 4,653,519 | 3/1987 | Kanner | 366/273 |

*Primary Examiner*—David A. Scherbel
*Assistant Examiner*—Patrick F. Brinson
*Attorney, Agent, or Firm*—Blakely, Sokoloff Taylor Zafman

[57] ABSTRACT

A magnetic coupled mixer which contains a drive magnet that can be remotely coupled to a driven magnet. The drive magnet is coupled to a motor shaft assembly by a yoke. The yoke is adapted to translate relative to the motor shaft assembly and move the drive motor between a first position and a second position. The magnets are decoupled when the yoke and drive magnet are in a first position. When the yoke is moved into the second position the drive magnet is magnetically coupled to the driven magnet, such that rotation of the drive magnet rotates the driven magnet. The yoke has an annular groove that is adapted to receive a lever. The lever can be rotated by the operator to move the yoke and drive magnet between the first and second positions.

7 Claims, 3 Drawing Sheets

COUPLING METHOD FOR HIGH POWER MAGNETIC DEVICES

BACKGROUND OF THE INVENTION

1. Field of the Invention

The present invention relates to an apparatus and method for installing a magnetic coupled mixing motor.

2. Description of Related Art

Chemical compounds are typically mixed within an agitator tank that contains a rotating impeller. Some agitator tanks include a magnetic coupler which couples the impeller to a motor located at the exterior of the tank. Magnetic couplers typically contain a drive magnet attached to the motor and driven magnet connected to the impeller. The magnets are placed in close proximity to each other so that rotation of the drive magnet induces a rotation of the driven magnet and impeller.

The installation of a magnetic coupled mixer typically requires the manual placement of the drive magnet into close proximity with the driven magnet. As the installer is placing the drive magnet near the driven magnet, the attractive force of the two magnets tends to pull together the two members. For relatively large mixers this magnetic force can be greater than the strength of the installer. The pull of the magnets may lead to injuries if the installer's fingers or other extremities are caught between the magnets. Additionally, the magnets are difficult to pull apart, thereby increasing the difficulty in removing or repairing the motor. It would therefore be desirable to have a magnetic coupled mixer assembly which allows the motor magnets to be remotely coupled and decoupled.

SUMMARY OF THE INVENTION

The present invention is a magnetic coupled mixer which contains a drive magnet that can be remotely coupled to a driven magnet. The drive magnet is coupled to a motor shaft assembly by a yoke. The yoke is adapted to translate relative to the motor shaft assembly and move the drive motor between a first position and a second position. The magnets are decoupled when the yoke and drive magnet are in the first position. When the yoke is moved into the second position the drive magnet is magnetically coupled to the driven magnet, such that rotation of the drive magnet rotates the driven magnet.

The yoke has an annular groove that is adapted to receive a lever. The lever can be rotated by the operator to move the yoke and drive magnet between the first and second positions. To install the magnetic coupled motor mixer, the driven magnet is first mounted within the inner cavity of the tank. The drive magnet and yoke are then assembled onto the outer surface of the tank such that the drive magnet is located in the first position. The lever is then rotated to move the yoke and drive magnet into the second position. The magnets can be subsequently decoupled by rotating the lever and moving the drive magnet back into the first position.

Therefore it is an object of the present invention to provide a magnetic coupled mixer which allows the magnets to be remotely coupled and decoupled.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
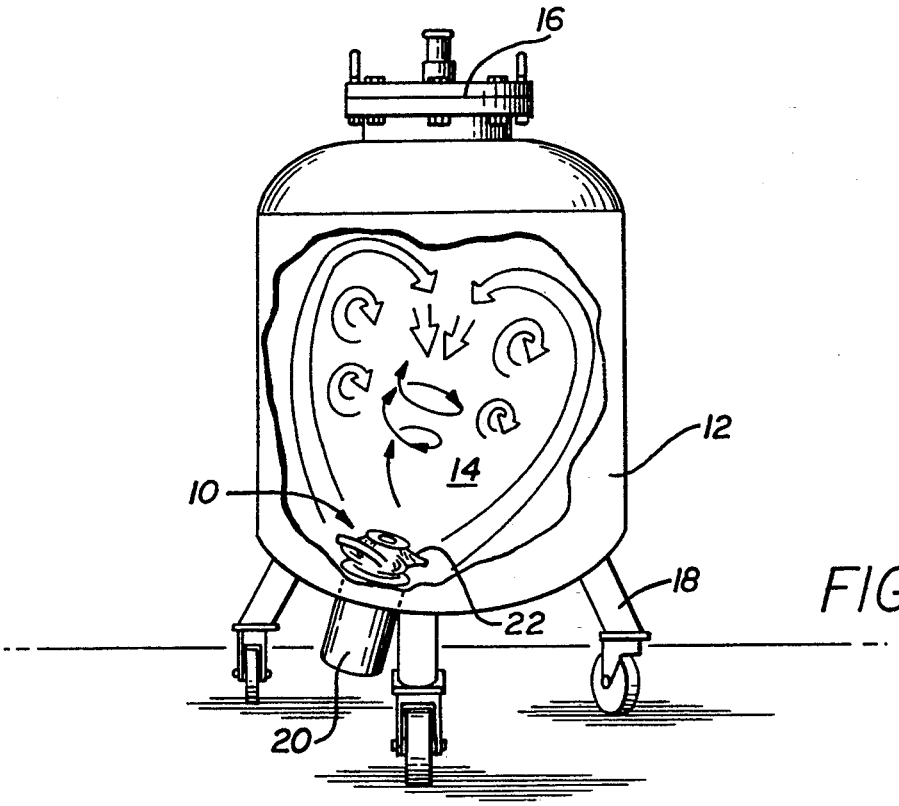
FIG. 1 is a perspective view of a tank with a magnetic coupled mixer of the present invention.

Referring to the drawings more particularly by reference numbers, FIG. 1 shows a magnetic coupled mixer 10 mounted to an agitator tank 12. The tank 2 has an inner cavity 14 that is typically enclosed by a lid 16. The agitator tank 12 may also have a plurality of legs 18 that support and lift the tank. Mounted to the bottom of the agitator tank 12 is a motor 20 which rotates an impeller assembly 22 located within the inner cavity 14 of the tank. Rotation of the impeller 22 mixes the contents of the tank 12.

Figure 2:
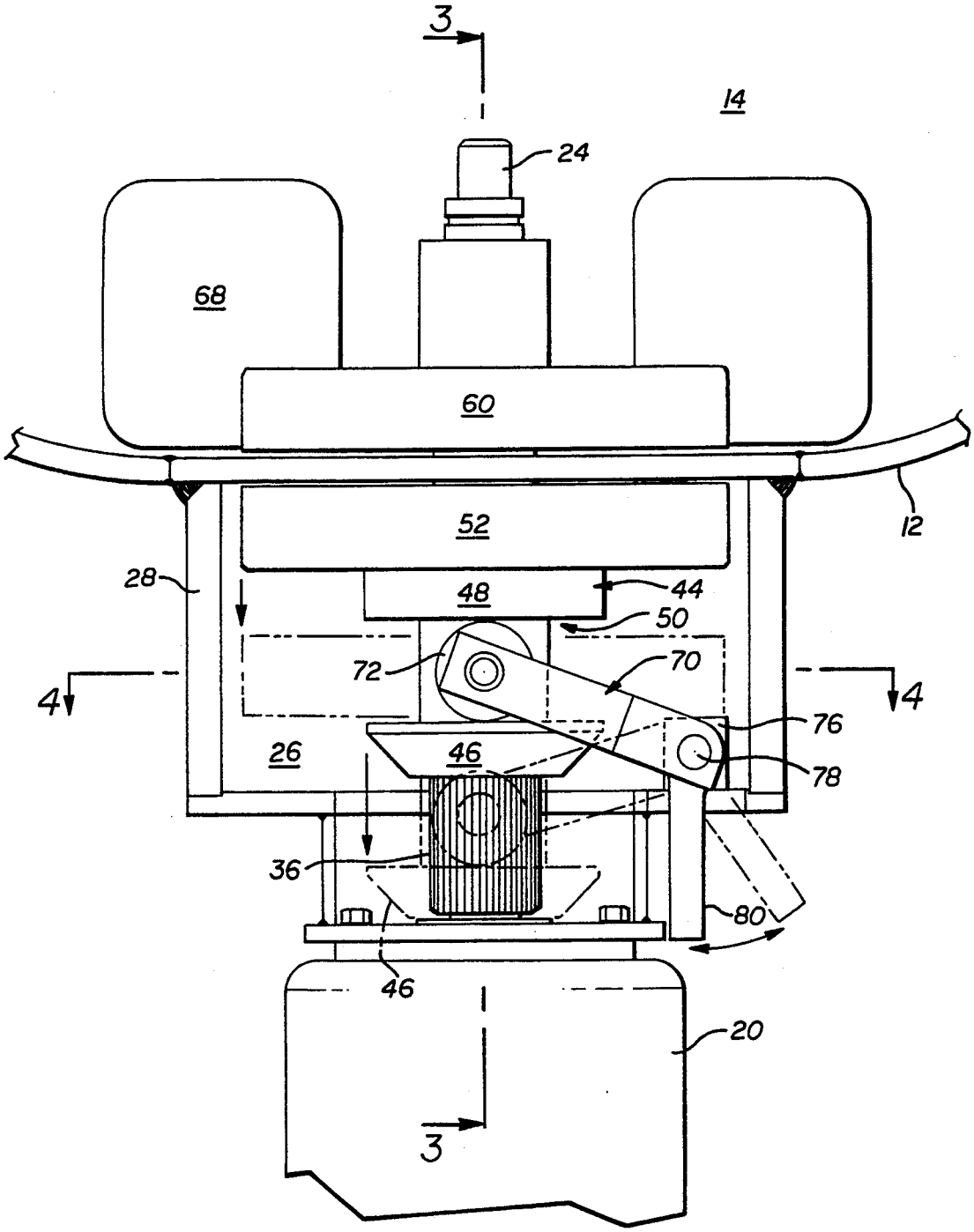
FIG. 2 is a cross-sectional view of the magnetic coupled mixer of FIG. 1 showing a yoke holding a drive magnet before assembly thereof.
Figure 3:
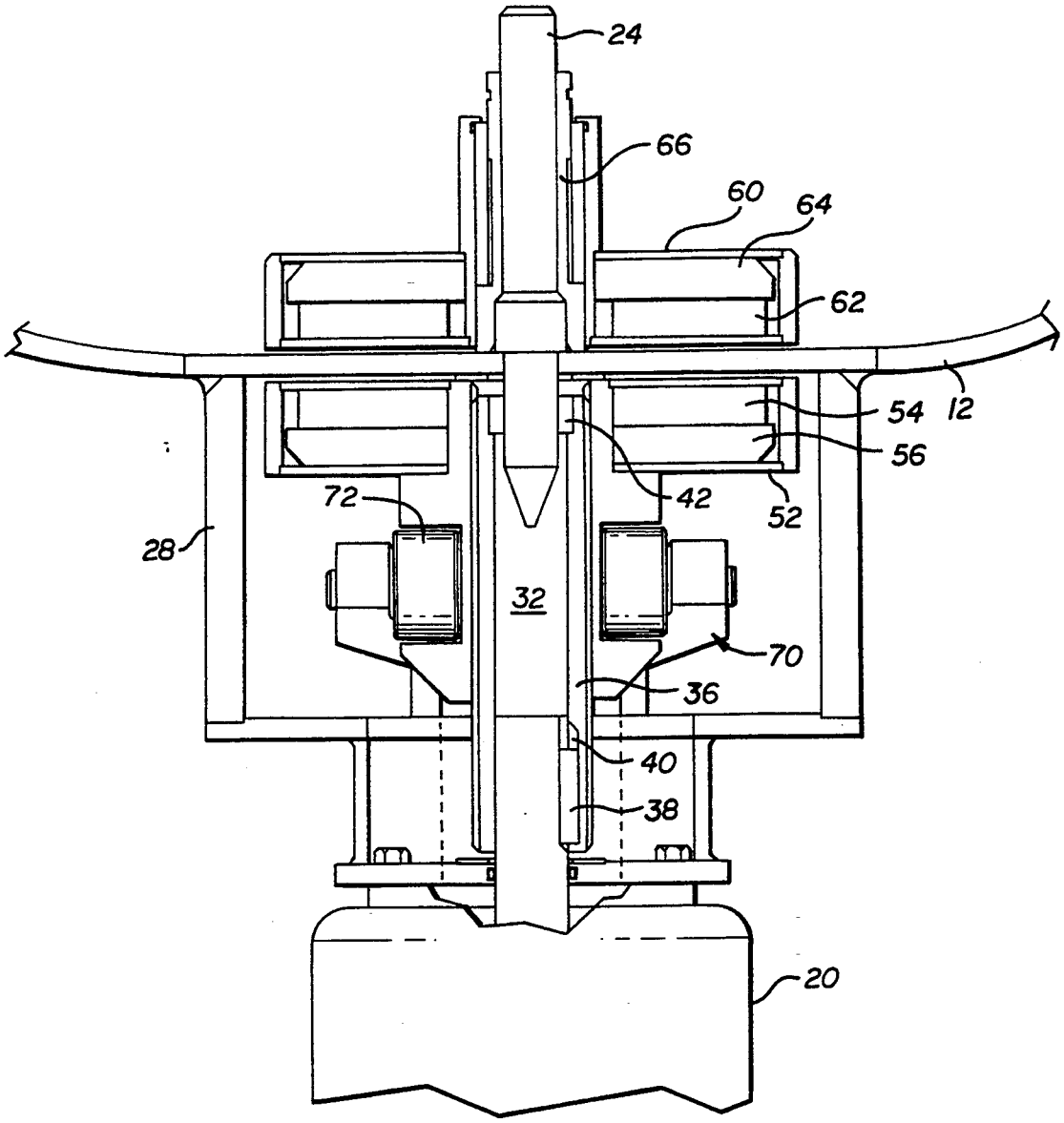
FIG. 3 is a cross-sectional view of the magnetic coupled mixer taken at line 3—3 of FIG. 2.

As shown in FIGS. 2 and 3, the magnetic coupled mixer 10 has a tank post 24 that extends from the inner cavity 14 into a magnet chamber 26. The magnet chamber 26 is defined by an outer mixing housing 28 that is mounted to the outer surface of the tank 12. The tank post 24 is coupled to an output shaft 32 of the motor 20, such that the shaft 32 can rotate relative to the post 24.

The mixer 10 includes a spline 36 which is located coaxially with the output shaft 32. The output shaft 32 has a tongue 38 which extends into a groove 40 of the spline 36, so that rotation of the shaft 32 rotates the spline 36. A support bearing 42 may be located between the tank post 24 and the end of the spline 36.

Figure 4:
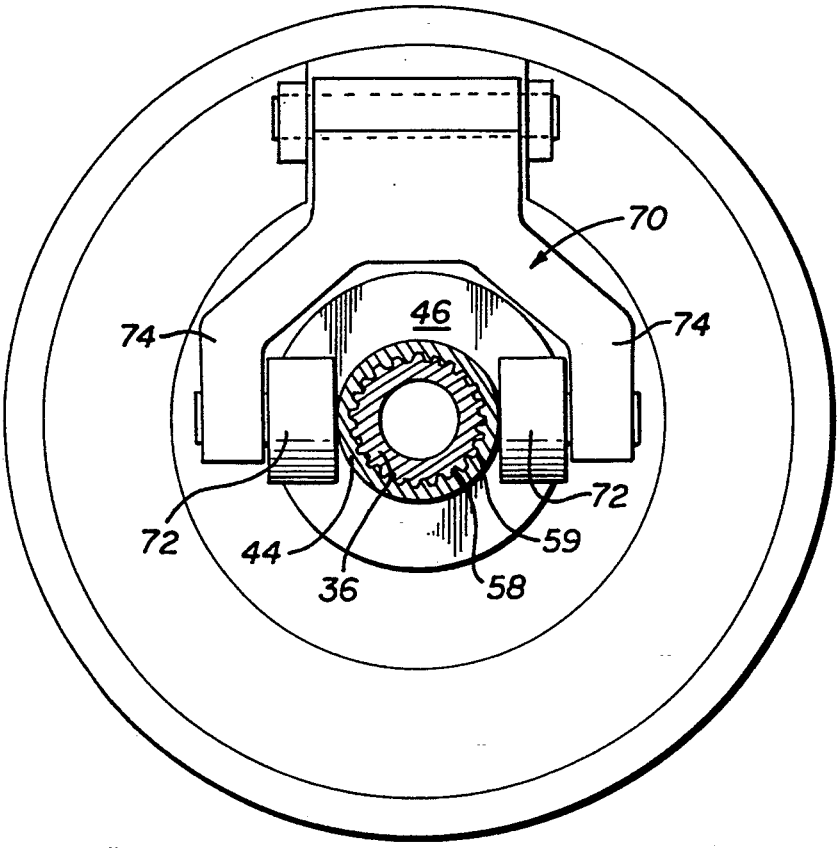
FIG. 4 is a cross-sectional view of the magnetic coupled mixer taken at line 4—4 of FIG. 2.

Adjacent to the spline 36 is a yoke 44 which is adapted to move translationally relative to the spline 36. The yoke 44 has an annular base flange 46 and an annular top flange 48 which define an annular groove 50. The annular base flange 46 supports a first magnet housing 52, which contains a drive magnet 54 and a drive magnet backplate 56. The first magnet housing 52 is adapted to move with the yoke 44 between first and second positions. As shown in FIG. 4, the spline 36 has a plurality of teeth 58 which cooperate with matching teeth 59 of the yoke 44, so that the drive magnet 54 rotates when the output shaft 32 of the motor 20 rotates the spline 36.

Coupled to the tank post 24 is a second magnet housing 60 which contains a driven magnet 62 and a driven magnet backplate 64. The drive 56 and driven 62 magnet backplates are typically constructed from a carbon steel which provide a path for the magnetic flux of the magnets. The second magnet housing 60 is coupled to the tank post 24 by a second bearing 66. Attached to the second housing 60 are a pair of impellers 68. The extension of the tank post 24 into the motor shaft 32 insures that the drive magnet 54 is concentric with the driven magnet 62.

The mixer assembly 10 includes a yoke lever 70 that is pivotally connected to the outer housing 28 and adapted to move the yoke 44 between the first and second positions. As shown in FIG. 4, the lever 70 has a pair of heads 72 that extend from a pair of arms 74. The arms 74 are constructed so that the heads 72 can be inserted into the annular groove of the yoke 44. Rotation of the lever 70 causes the heads 72 to abut the annular flanges and move the yoke 44 along the spline 36. The lever 70 is preferably connected to an outer housing boss 76 by a pin 78. The arms 74 are typically separated a sufficient distance to allow the yoke 44 to rotate while the heads 72 are within the annular groove 50. The lever 70 may have a handle 80 which can grasped and manually rotated by the operator. Alternatively, the yoke lever 70 may be connected to an actuator or other means that mechanically rotate the lever 70.

To assemble the magnetic coupled mixer 10 to the agitator tank 12, the tank post 24, second magnetic housing 60 and outer mixing housing 28 are mounted to the tank as shown in FIG. 2. The yoke 44 and drive magnet 54 are located in a first position away from the tank 12 and the driven magnet 62. As shown in FIG. 1, the lever 70 is then rotated to move the yoke 44 and drive magnet 54 into the second position, such that the drive magnet 54 is magnetically coupled to the driven magnet 62.

After installation, the motor is typically activated to spin the output shaft 32 and rotate the drive magnet 54. Rotation of the drive magnet 54 induces a rotation of the driven magnet 62 and impeller portion 68 of the second magnet housing 60.

To disassembly the magnetic coupled mixer 10, the lever is rotated to move the drive magnet 54 back into the first position. The present invention allows an operator to readily combine and separate the magnets without exerting an excessive force or being exposed to possible injury from the magnets.

Given that the magnetic attraction of the drive and driven magnets is inversely proportion to the square of the distance between them, separation of the drive and driven magnets only a small distance, on the order of 1 to 2 inches, dependent of course on the strength of the respective magnets, is typically sufficient to accomplish the desired effect. This movement is accomplished by a 15° to 20° angular rotation of the yoke.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A magnetic coupled mixer, comprising:

an agitator tank a driven magnet located within said agitator tank;

a drive magnet magnetically coupled to the driven magnet;

drive shaft means coupled to said drive magnet;

a stirrer motor for rotating said drive shaft means and said drive magnet;

movement means for moving said drive magnet between a first position and a second position to thereby couple and decouple said drive magnet with said driven magnet;

said movement means including a yoke that is attached to said drive magnet for moving said drive magnet translationally relative to said drive shaft means.

2. The assembly as recited in claim 1, wherein said movement means include a lever coupled to said yoke, said lever moving said yoke between the first and second position, to couple and decouple said drive magnet and said driven magnet.

3. The assembly as recited in claim 2, wherein said lever has a pair of wheels that are captured by a pair of flanges that extend from said yoke.

4. The assembly as recited in claim 2, wherein said lever is pivotally connected to a housing.

5. The assembly as recited in claim 2, wherein said yoke is coupled to said drive shaft by a spline.

6. The assembly as recited in claim 1, wherein said driven magnet is located within an inner cavity of a tank and said drive magnet is located on an exterior of said tank.

7. An agitator tank assembly, comprising:

a tank that has an inner cavity;

an impeller located within said inner cavity;

a driven magnet operatively connected to said impeller;

a drive magnet magnetically coupled to the driven magnet;

a drive shaft coupled to said drive magnet;

a stirrer motor connected to said drive shaft for rotating said drive shaft and said drive magnet;

a yoke attached to said drive magnet and coupled to said drive shaft, said yoke having a groove and being adapted to move relative to said shaft; and a lever which has a wheel located within said groove of said yoke, said lever being adapted to rotate and move said yoke between a first position and a second position thereby coupling and decoupling said drive magnet and said driven magnet.

* * * * *